United States Patent [19]

Hope et al.

[11] 4,214,379

[45] Jul. 29, 1980

[54] DRYER RACK USING STAGGERED ROLLERS

[76] Inventors: Henry F. Hope, 3192 Huntingdon Rd., Huntingdon Valley, Pa. 19006; Stephen F. Hope, 2548 Wyandotte Rd., Willow Grove, Pa. 19090

[21] Appl. No.: 780,922

[22] Filed: Mar. 24, 1977

Related U.S. Application Data

[63] Continuation-in-part of Ser. No. 737,199, Oct. 29, 1976, Pat. No. 4,079,635, which is a continuation-in-part of Ser. No. 555,961, Mar. 10, 1975, Pat. No. 3,989,176, said Ser. No. 555,961, is a continuation-in-part of Ser. No. 457,829, Apr. 4, 1974, abandoned, and Ser. No. 513,244, Oct. 9, 1974, Pat. No. 3,952,610.

[51] Int. Cl.[2] ..... F26B 13/08

[52] U.S. Cl. ..... 34/159; 34/155; 34/160; 74/412 R; 74/421 R; 226/189

[58] Field of Search ..... 34/155, 159, 160, 157; 74/421 R, 665 GA, 665 P, 412 R; 226/188, 189, 119; 354/319, 320, 321, 322, 339

[56] References Cited

U.S. PATENT DOCUMENTS

| | | | |
|---|---|---|---|
| 2,070,483 | 2/1937 | Hurxthal | 34/157 X |
| 2,640,277 | 6/1953 | Dungler | 34/160 |
| 3,073,590 | 1/1963 | Romeo et al. | 271/274 |
| 3,147,090 | 9/1964 | Russell et al. | 34/160 |
| 3,366,025 | 1/1968 | Layne | 354/322 |
| 3,405,456 | 10/1968 | Shepherd | 34/155 |
| 3,434,225 | 3/1969 | Knibiehly | 34/160 |
| 3,834,040 | 9/1974 | Russell et al. | 34/160 |

FOREIGN PATENT DOCUMENTS

| | | | |
|---|---|---|---|
| 964768 | 7/1949 | Fed. Rep. of Germany | 34/160 |

*Primary Examiner*—Albert J. Makay
*Assistant Examiner*—Harold Joyce
*Attorney, Agent, or Firm*—Weiser, Stapler & Spivak

[57] ABSTRACT

A dryer rack for automatic film developing machines, which is remarkably simple in construction and easy to maintain, which is highly efficient, and which dries the film quickly, thoroughly and with remarkable freedom from blemishes.

Gear driven transport rollers arranged in a staggered pattern carry the film through the rack along a sinuous path. The rollers are thinner, more closely spaced and more numerous than in conventional dryer racks. Low-pressure, high-volume fans blow air directly onto the rollers without using air distribution tubes. The rollers themselves form air jets which distribute the drying air flow advantageously over the film surfaces.

This rack, with its numerous gear driven transport rollers, is powered by a series of large power transmitting gears positioned along the rack, from which power is tapped off by smaller diameter coaxial gears. The latter in turn drive clusters of the roller drive gears. This highly efficient and extremely smooth operating gear system makes practical the use of the desired large numbers of closely spaced thin transport rollers, without requiring excessive driving power and without causing uneven roller movement harmful to the photographic emulsion. This, in conjunction with the exceptionally favorable air flow patterns which prevail in this rack using thin, staggered rollers, produces exceptionally rapid and blemish-free film drying.

20 Claims, 9 Drawing Figures

DRYER RACK USING STAGGERED ROLLERS

RELATED CASES

This application is a continuation-in-part of our copending U.S. patent application Ser. No. 737,199, filed Oct. 29, 1976, now U.S. Pat. No. 4,079,635, issued Mar. 21, 1978, which in turn is a continuation-in-part of our patent application Ser. No. 555,961 filed Mar. 10, 1975 now U.S. Pat. No. 3,989,176, issued Nov. 2, 1976. The said application Ser. No. 555,961 in turn is a continuation-in-part of our patent applications Ser. No. 457,829, filed Apr. 4, 1974, now abandoned, and Ser. No. 513,244, filed Oct. 9, 1974, now U.S. Pat. No. 3,952,610, issued Apr. 27, 1976.

In the foregoing, prior patent applications and now issued patents, there is taught a highly efficient, novel concept for powering racks containing long strings of transport rollers. In accordance with that concept, each roller is coaxially rotated by its own roller drive gear. Clusters of these roller drive gears are driven by respective cluster drive gears. The cluster drive gears, in turn, are coaxially rotated by power transmitting gears of larger pitch diameters.

The power transmitting gears drive each other, thereby providing the main flow of power to the rack. Each cluster drive gear taps off from this main flow of power the fraction needed to drive its own cluster of gears and their coaxially driven transport rollers.

The present invention involves a still further utilization of this novel concept, in conjunction with other techniques with which it cooperates in a highly advantageous manner. Thus the present invention further demonstrates the broad scope of useful applicability of the above-mentioned concept.

BACKGROUND OF THE INVENTION

The present invention relates generally to apparatus for drying moist webs or sheets of materials, as these are transported through the final stages of a machine in which they have previously passed through one or more web treatment baths. The apparatus is particularly suitable for photographic film developing machinery.

Machines are known which utilize an extended transport roller system for carrying flexible workpieces, such as photographic films or papers. Typical of such machines are those used to develop photographic films. These machines utilize a series of treatment baths, through which the films are carried in succession by means of transport roller racks extending into these treatment baths. After leaving the last of these baths, the films pass through another transport roller rack within which they are subjected to air flow in order to dry the films before they exit from the developing machine.

In this final transport roller rack, which will be referred to hereafter as the dryer rack, it has been customary to provide a system of air distribution tubes for applying a flow of drying air to the film passing through the dryer rack. These distribution tubes were typically positioned parallel to the transport rollers themselves, and adjacent the gaps between rollers. These tubes had air outlets, or nozzles facing toward the film being transported between the rollers. One or more air blowers were also provided, and these were connected to the inlets of the tubes, usually through manifold ducts leading to the individual distribution tubes. Such a system of air distribution tubes was usually present on both sides of the dryer rack, so as to provide drying of both sides of the film.

Dryer racks of the foregoing types were beset with a variety of problems.

The mechanical construction of such a rack was manifestly complex, and correspondingly costly. Not only did the basic roller rack have to be provided, but so did the elaborate system of air distribution tubes, and supply ducts for these tubes. All this hardware had to be mechanically positioned and structurally supported, and this had to be done with considerble precision, so that the air discharge nozzles would be close to the film, but not interfere with its movement or with the movement of the rollers and of their driving mechanisms.

The constrictions to the drying air supply formed by these ducts and tubes required the use of high pressure blowers, which are expensive to acquire and costly to operate.

These drawbacks became accentuated with increasing width of the dryer rack, since this necessitated longer air distribution tubes, stronger mountings, more powerful blowers, etc. Indeed, those problems tended to impose a ceiling on dryer rack width, thereby limiting the ability of automatic film developing machines to process wide films, or to process large numbers of narrower films simultaneously, side by side.

The air ducts and tubes also created maintenance problems since they had a tendency to clog up with dust during operation. This made it necessary to stop the machine and go through quite complicated cleaning procedures including partial disassembly of the machine to reach the clogged air outlets.

In order to allow room for this placement of the distribution tubes, it was also necessary to position consecutive transport rollers quite far apart. Two disadvantages resulted.

First, this placed limits on the total number of such rollers which could be accommodated in a dryer rack of given over-all length.

The rollers in a drying rack are relied on to pick up some of the moisture from the film being transported by these rollers, thereby contributing to the over-all drying process within the rack. By limiting the number of such rollers which can be accommodated, this part of the drying capability of the rack is undesirably restricted.

Secondly, the far-apart spacing of the rollers made it necessary to provide additional guidance members for the film passing from one roller to the next, to prevent the film from deviating from its intended path, and even becoming caught in the rest of the dryer rack mechanism.

Simply lengthening the dryer rack, and concomitantly increasing the number of transport rollers, is not a satisfactory solution. This would increase the over-all size of the film developing machine, which is undesirable and, in some applications, altogether out of the question. It would also further multiply the complexity stemming from additional air distributing tubes, ducting, film guidance members, and so forth. Also such increase in numbers of transport rollers, if driven in the conventional manner by a train of meshing roller drive gears powered from one end of the train, would quickly become hard to drive, and would be subject to chatter and vibration which could easily damage the film emulsion, which is in a delicate and easily damaged state during passage through the dryer rack.

SUMMARY OF THE INVENTION

In the present invention the dryer rack has its film transport rollers positioned much closer together than in the conventional type of rack discussed above, the individual rollers are much thinner, and there is a much larger number of these rollers.

Also in the present invention, the tubes for distributing air to the gaps between the rollers are omitted, and so are the ducts for bringing air to these tubes. Instead of high-pressure blowers, simple air-moving fans are used to blow large volumes of air from both sides generally over areas of the roller train. This air is then channeled by the rollers themselves into the narrow spaces between the closely spaced transport rollers. This in effect accelerates the air and creates what amount to jets of air impinging on the film.

The transport rollers are positioned in the rack without forming nips in a zig-zag or staggered pattern, such that the film follows through the rack a generally sinuous path defined by the spaces between the consecutive transport rollers. In this way, alternate sides of the film are supported by consecutive rollers. Because no nips are formed, there is no requirement for precise dimensioning of the individual rollers, or for precise positioning of roller pairs in relation to each other.

The transport rollers, arranged as described above, are driven in accordance with the same highly advantageous concept as is taught in our previously referenced patent applications and patents. In accordance with that concept, power is applied to the rack through a series of relatively large power transmitting gears which are positioned along the rack, and which drive one another. These power transmitting gears, in turn, coaxially rotate cluster drive gears of smaller pitch diameter. Each cluster drive gear rotates through meshing a cluster of the individual roller driving gears, which may also be in mesh with one another. Use of this concept in the dryer rack of the invention more than makes up for the fact that many more transport rollers have to be driven as part of the rack. The power required to drive this rack is small enough to present no problems. The driving forces are applied extremely smoothly, and with such outstanding freedom from gear chatter or vibration that there is little or no danger that the emulsion on the films passing through the rack will be damaged.

We have found that a dryer rack constructed in accordance with the present invention represents a major improvement over the type of conventional rack previously described. The construction of the rack is comparatively simple and inexpensive. The maintenance requirements are reduced. A greater drying effect can be obtained in a given length of rack. Despite the increased number of transport rollers, the driving power required is low, and the film is less subject to damage during passage through the rack.

These advantages all result from the highly favorable cooperation between the arrangement of the transport rollers and the use of the particular driving means for these transport rollers, all in accordance with the present invention.

It is therefore an object of the present invention to provide a transport roller rack, particularly for drying photographic films, which is greatly improved in a number of important respects.

It is another object to provide such a dryer rack which does not require an elaborate air distribution system.

It is another object to provide such a dryer rack which does not require high-pressure blowers.

It is another object to provide such a dryer rack in which an exceptionally large number of transport rollers can be used without requiring excessive driving power or causing chatter and vibration harmful to the emulsion.

It is another object to provide such a rack in which the dimensions of the transport rollers, and their positioning relative to each other, are not critical.

For further details, reference is made to the discussion which follows, in the light of the accompanying drawings, wherein like reference characters apply to similar parts throughout and in which:

DETAILED DESCRIPTION

Referring to FIGS. 1-7, there are shown different views of the same dryer rack 10, adapted to be installed for example, in a photographic film developing machine, and to dry strips of film while they are being transported through that rack.

Figure 7:
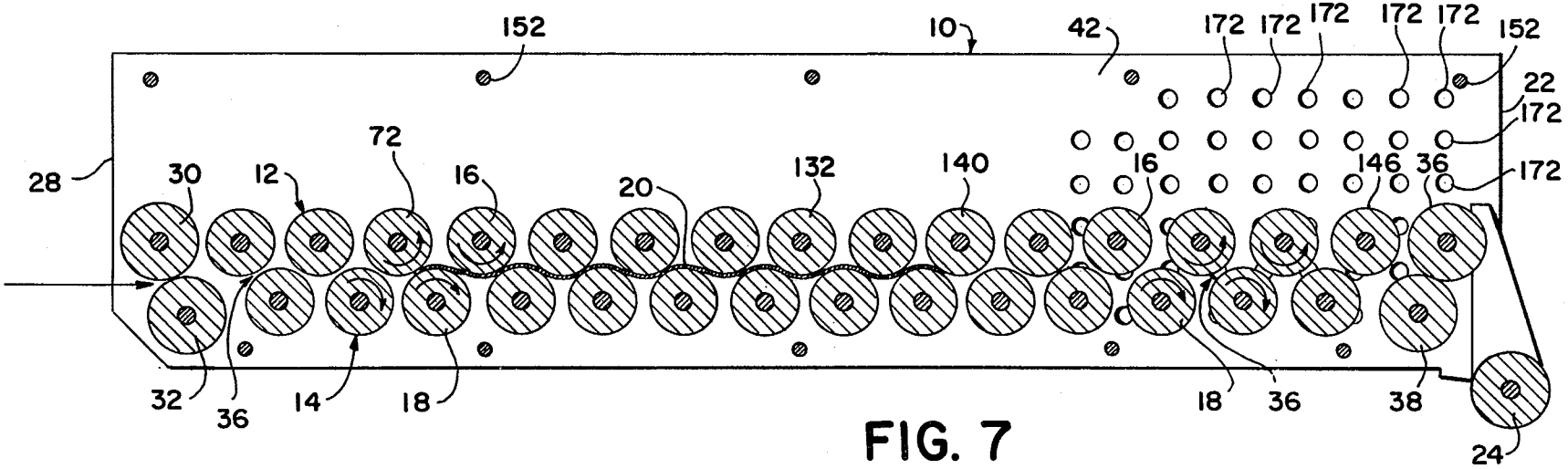
FIG. 7 is a cross-sectional view of the rack taken along line 7—7 of FIG. 1, looking in the direction of the arrows.

As is best seen in FIG. 7, the dryer rack 10 includes two sets or groups of rollers arranged in parallel, spaced rows 12,14. The upper row 12 comprises a plurality of rollers generally designated 16; the lower or bottom row 14 comprises a plurality of similar rollers generally designated 18.

The rollers 16 in the upper row 12 are staggered with respect to the rollers 18 forming the bottom row 14. The relative positioning of these rollers, both horizontally and vertically, is such that strips or lengths of material 20 (e.g., photographic films) introduced between the adjacent rows 14, 16 will be urged to follow a sinuous path, as shown in FIG. 7, as the material is transported through the dryer rack 10 in the direction of the arrow in FIG. 7.

Figure 8:
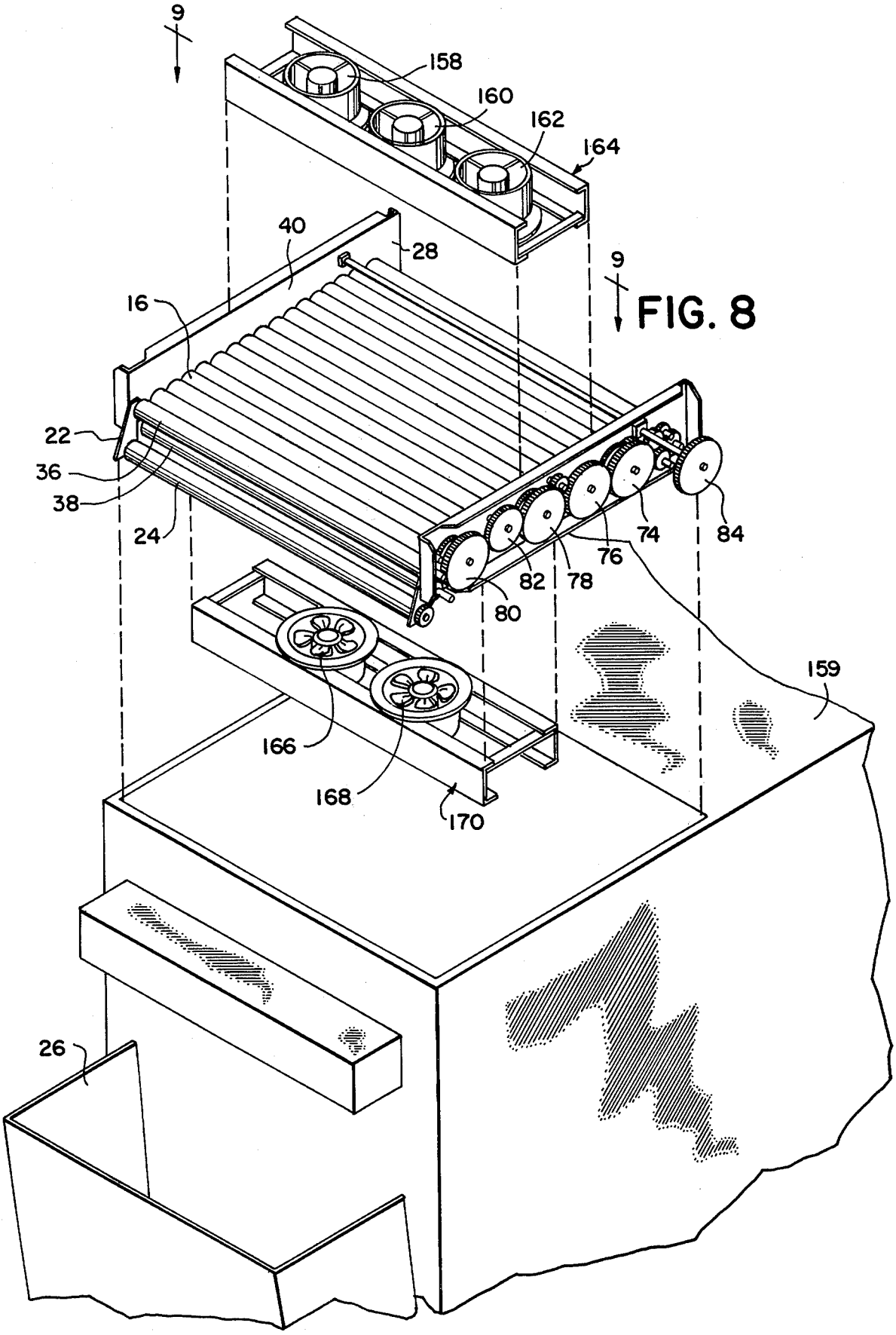
FIG. 8 is an exploded, perspective view showing the dryer rack in association with tiers of fans within a film processing machine.

At the exit end 22 of the rack 10, one or more exit rollers 24 can be provided which serve to direct the films or materials 20 downwardly from the general plane of travel as they are transported through the dryer rack 10. In one configuration, as illustrated in FIG. 8, the fully processed and dried film 20 can be directed into a lower positioned hopper 26 by the exit roller 24.

At the inlet end 28 of the dryer rack 10 are rotatively positioned two additional rollers 30, 32. The roller 30 forms with roller 32 a nip which serves as the lead-in for films or other materials 20 to be introduced into dryer rack 10. The films 20 emerging from the nip of rollers 30, 32, are directed into the spaces 34 between staggered upper rollers 16 and lower rollers 18. The roller 36 forms a nip with a complementary roller 38 and serves to propel films 20 emerging from being transported through the dryer rack 10 out of the rack, with further guidance being imparted by the exit roller 24.

Figure 1:
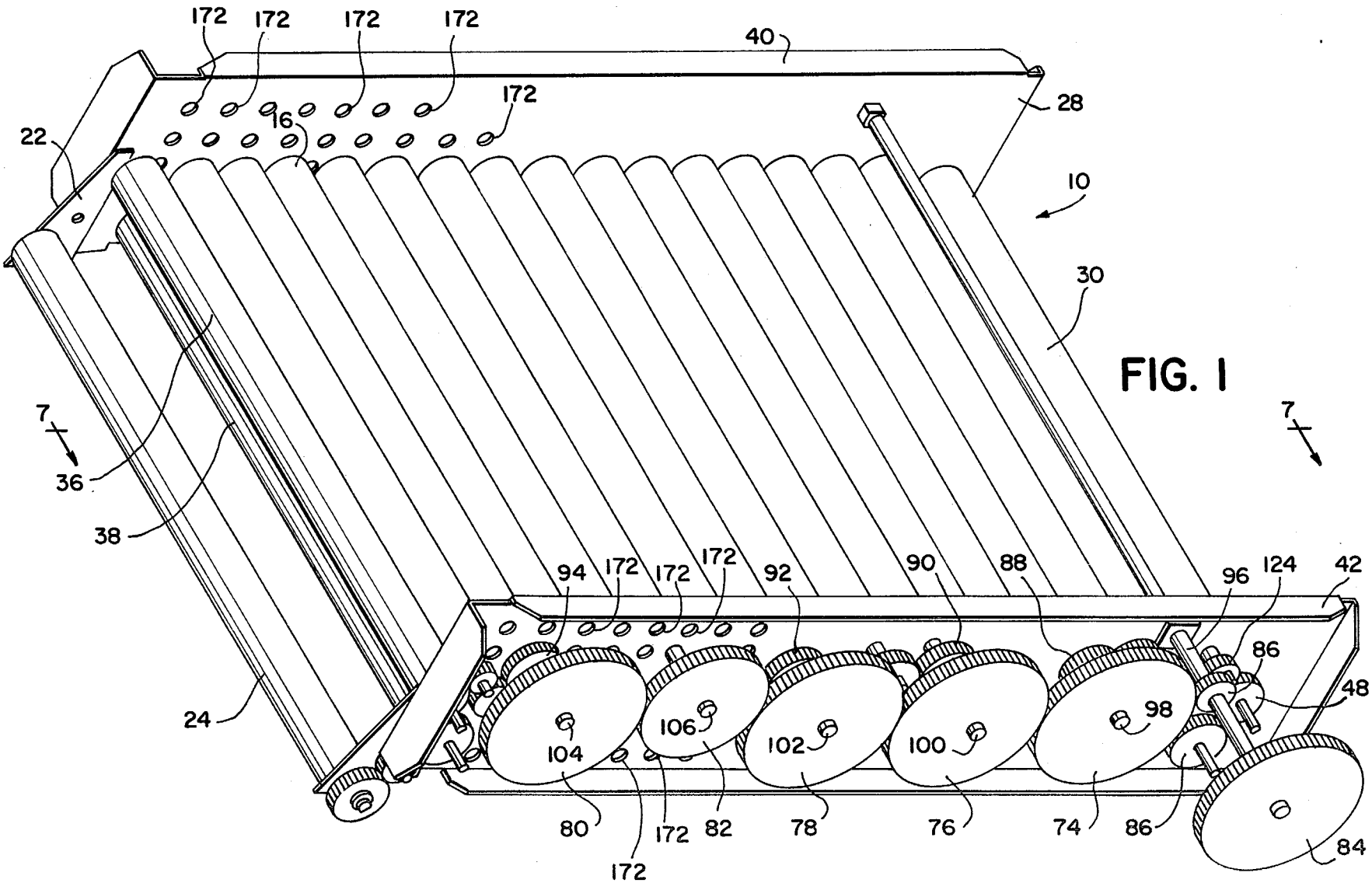
FIG. 1 is a perspective view of a dryer rack embodying the present invention, viewed from the power transmitting gear train side.
Figure 2:
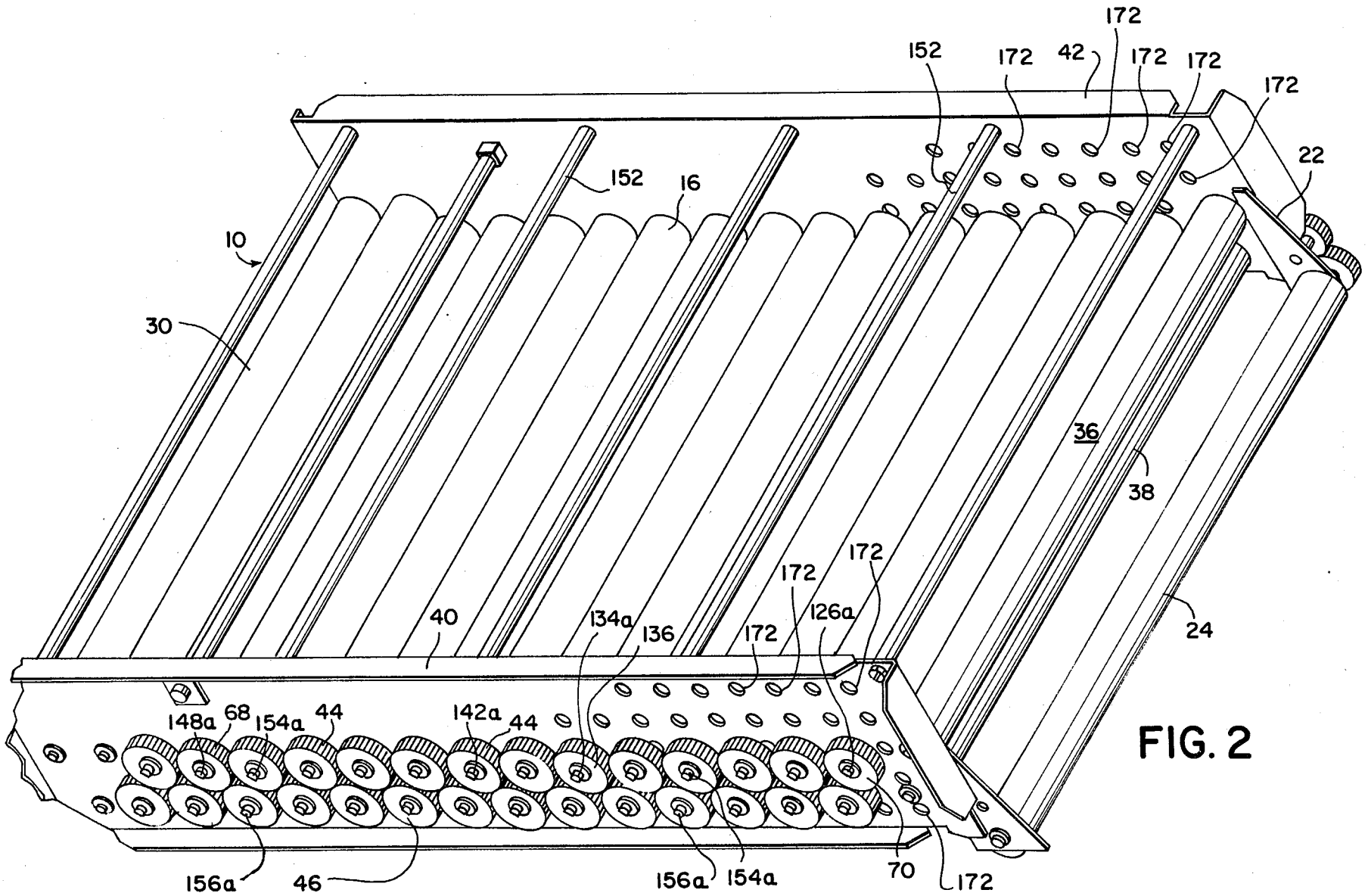
FIG. 2 is a perspective view of the rack of FIG. 1 viewed from the opposite side.

The rollers 16, 18, 24, 30, 32, 36, 38 are all held in horizontal positions between the spaced frame members 40, 42 and are mounted on shafts journalled for rotation within these frame members. All the rollers shown in FIG. 7 are driven by gears, which are respectively shown in FIGS. 1–6. In FIG. 2, particularly, there is shown a set of upper gears 44, respectively attached to the ends of the same shafts on which are mounted the upper rollers 16. There is also a set of lower gears 46 attached to ends of the corresponding shafts on which are mounted the lower rollers 18. It will be noted that all of the upper roller gears 44 and lower roller gears 46 are positioned adjacent the right-hand frame member 40, as viewed in FIGS. 2 and 7.

Figure 5:
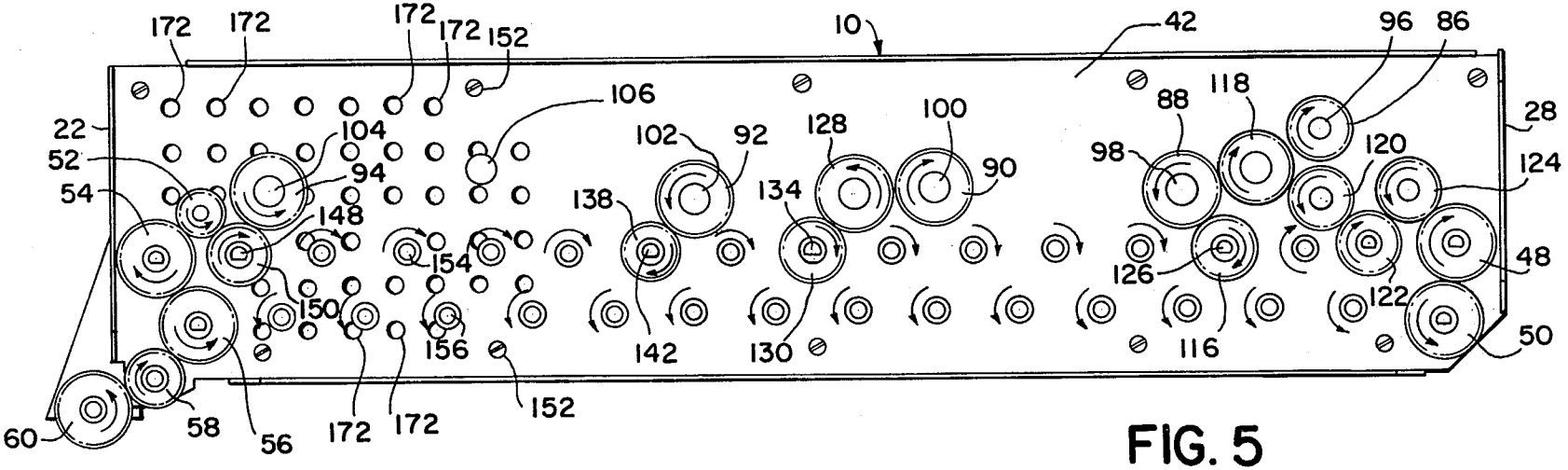
FIG. 5 is a side elevational view of the same rack showing the underlying gear configuration of FIG. 3.
Figure 6:
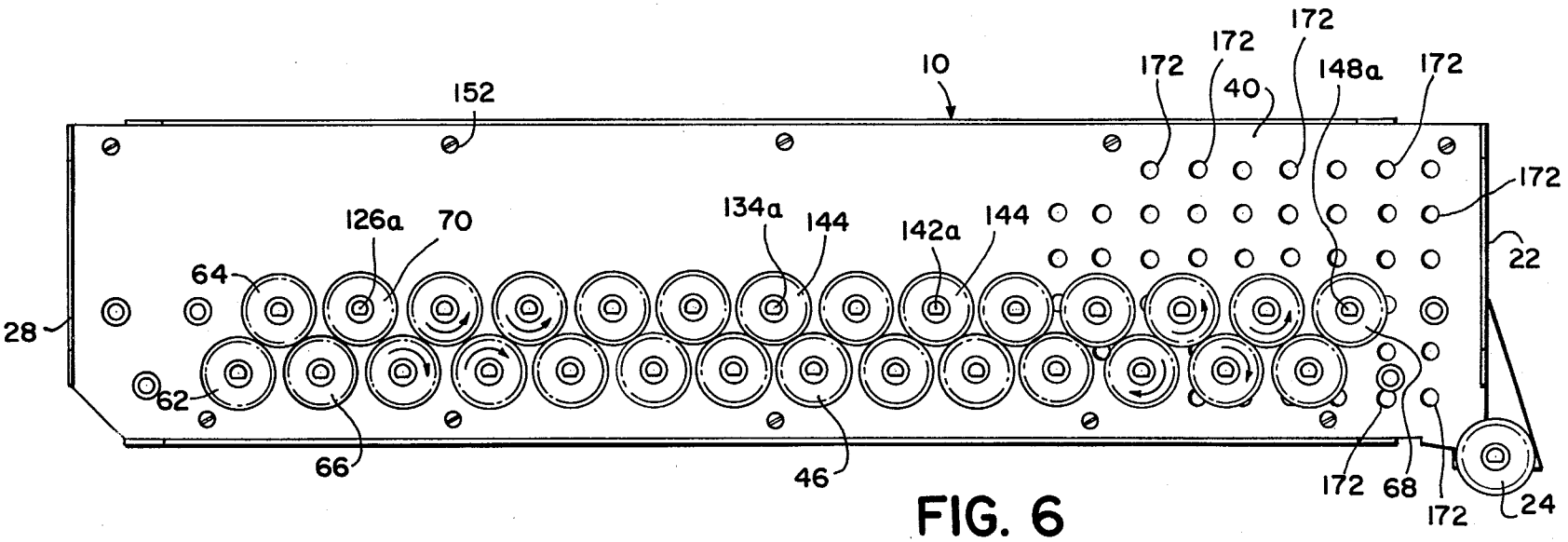
FIG. 6 is a side elevational view of the same rack viewed from the same side as in FIG. 2.

The inlet rollers 30 and 32, it will be noted, do not have gears at these ends adjacent the right frame member 40. Rather they have gears 48 and 50 attached to the opposite ends of these respective rollers, as seen in FIG. 5, on the outside of the left frame member 42. Moreover, the outlet rollers 24, 36 and 38 also have gears at these opposite ends, outside of left frame member 42, such gears being designated respectively 52, 54, 56, 58 and 60 in FIG. 5. The inlet and outlet rollers have gears positioned adjacent the left frame member 42 in spaced relationship to the gears 44, 46 which drive the plurality of upper and lower rollers 16, 18 which are positioned adjacent the right frame member 40.

The staggered rollers in respective upper and lower rows 12, 14 are so dimensioned that they do not touch, i.e., so that they do not form nips for the engagement of the materials or films 20 to be transported by them. On the other hand, the gears attached to these rollers which are designated generally by the numerals 44, 46 are so dimensioned that they do mesh along diagonal lines, but not horizontally. In other words, each upper roller gear 44 meshes with a diagonally adjacent lower roller gear 46, but not with its horizontally adjacent gear or gears.

It will be noted that the respective upper roller gears 44 and lower roller gears 46 at the ends of the sets of staggered upper and lower rollers 16, 18 likewise form sets of staggered gears. As a result, these gears will all rotate in unison and so will the rollers to which they are attached. More particularly, if the upper roller gears 44 rotate in a counterclockwise direction, as indicated by arrows drawn on these gears in FIG. 6, then the lower roller gears 46 will rotate in a clockwise direction. The corresponding rotational movements will prevail for the rollers to which these gears are attached (FIG. 7).

It will be apparent from FIG. 7 that the effect of staggered location of the rollers 16, 18 is to impart a sinusoidal movement to films 20 introduced at the nip between the inlet rollers 30 and 32, as the film is transported horizontally through the dryer rack 10 between the staggered upper and lower rollers 16, 18.

In accordance with the present invention, there is also utilized an additional set of gears, not in mesh with any of the roller driving gears 44, 46. This additional set of gears is visible in FIGS. 1, 3, 4 and 8. It consists of the five large diameter gears 74, 76, 78, 80 and 82 and the main drive gear 84 and small drive gear 86 associated with these large gears.

Figure 3:
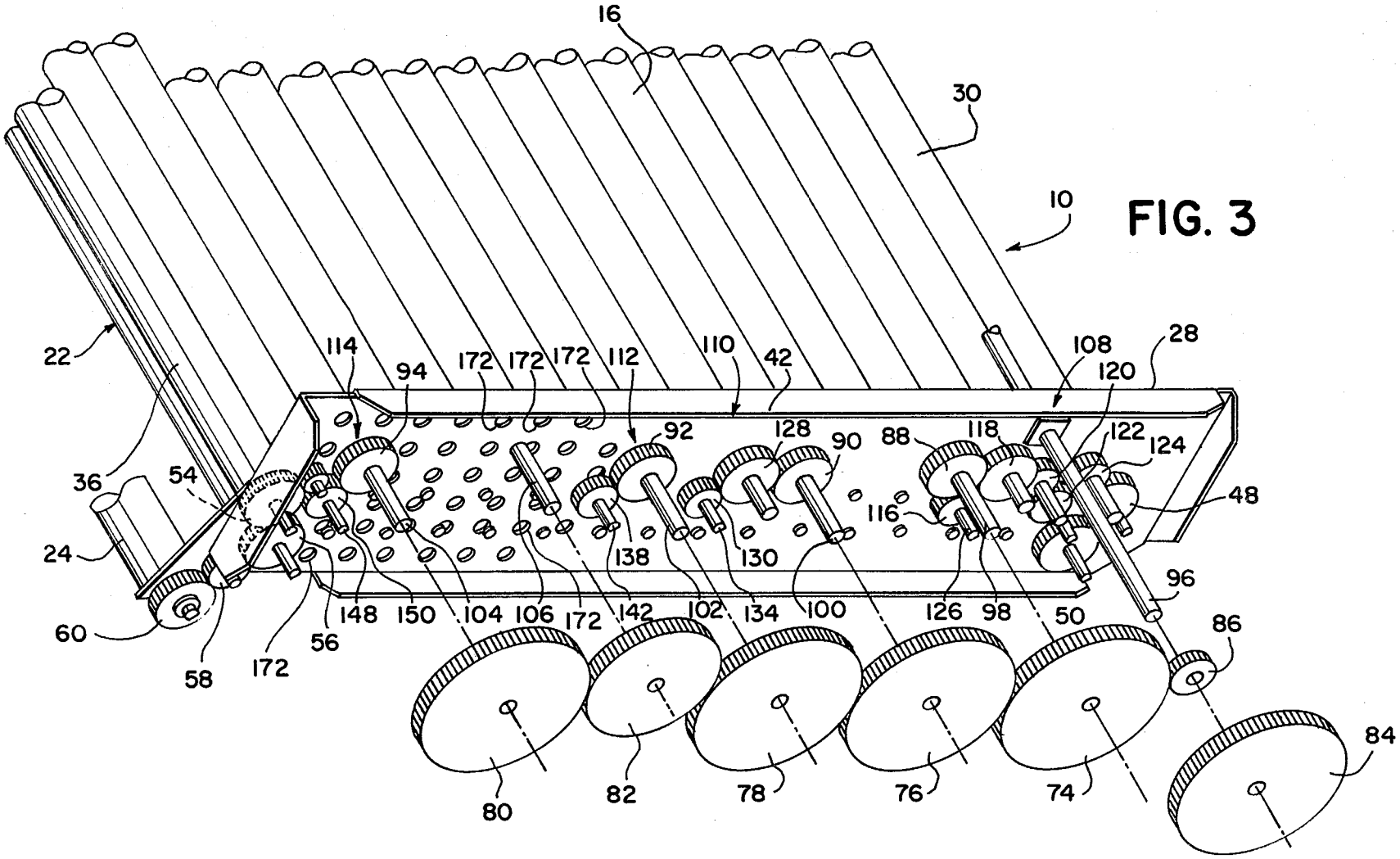
FIG. 3 shows a portion of the same rack as FIG. 1, exploded to show the gears underlying the power transmitting gears.

As particularly evident in FIG. 3 the large gears 74, 76, 78, 80 are coaxially mounted with small gears 88, 90, 92 and 94, respectively, which gears are journalled within and mounted adjacent to the left frame member 42. The main drive gear 84 is coaxial with the small drive gear 86 which is not attached to any roller, but which meshes with the first large diameter gear 74 which in turn meshes with large diameter gear 76.

Driving power for the entire dryer rack 10 is applied at one end of the rack through the main drive gear 84 from a motor through a suitable drive pinion (not shown).

This driving power then flows through large diameter gears 74, 76, 78, 82 and 80 which will be referred to hereafter as the power transmitting gears, or power gears, for short. As will be seen, the gear 82 serves to reverse direction from one power gear 78 to the next power gear 80 so that the four power transmitting gears 74, 76, 78, 80 rotate in the desired direction, as indicated by the arrows (FIG. 4).

Through the coaxial connection between each power gear 74, 76, 78, 80 and the corresponding small gear 88, 90, 92 and 94 which it respectively rotates, there is tapped off a portion of the power flowing along the series of power gears and the tapped power is applied to the remaining gears of the rack 10 and through them to the rollers. These coaxial smaller gears will be referred to hereafter as the cluster drive gears. In this embodiment, it will be noted that these cluster drive gears do not directly drive any transport rollers. Rather, they transmit the power tapped off from the respective power transmitting gears through meshing to other gears which in turn do themselves drive the rollers 16, 18, 30, 32, 36, 38 and 24 which comprise the dryer rack 10. A group of such roller drive gears in the vicinity of any given cluster drive gear 88, 90, 92 or 94 and directly or indirectly meshing with same, is hereafter referred to as a cluster or a gear cluster.

Figure 4:
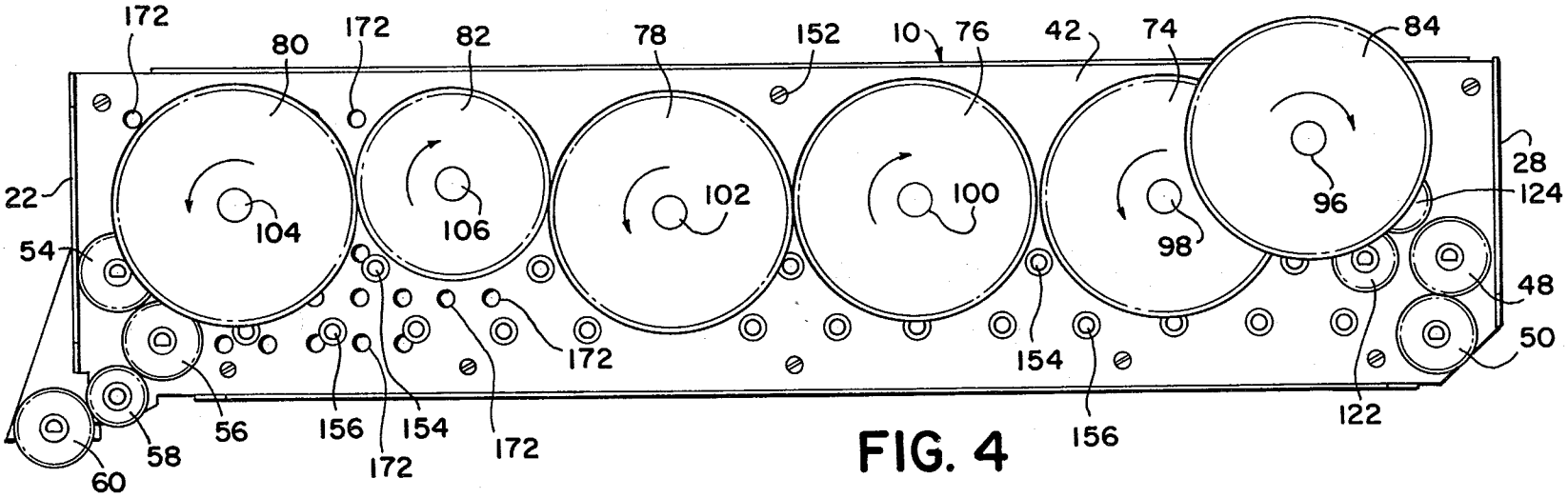
FIG. 4 is a side elevational view of the rack of FIG. 1, viewed from the same side as in FIG. 1.

As is best seen in FIGS. 3, 4 and 5, the cluster drive gear 88 meshes directly and indirectly with the gears 116, 118, 120, 122, 124, 48 and 50. As above set forth, the inlet roller gears 48, 50 are connected to rotate the attached inlet rollers 30, 32. Gear 116 rotates its shaft 126, which shaft is directly connected through an upper roller 146 to rotatively drive the end upper roller gear 68. The shaft 126 may be carried across the rack to the opposite frame member 40 or may be a split shaft **126*a* fabricated in well known manner by utilizing the roller 146 itself to transmit the rotative forces across the dryer rack 10**.

Similarly the cluster drive gear 90 meshes directly or indirectly with the gears 128, 130. Only gear 130 is rotatively connected to a roller, in this case, the upper roller 132. The roller gear 130 rotates its shaft 134, which shaft is directly connected through the upper roller 132 to rotatively drive the roller gear 136 at the opposite frame member 40. The shaft 134 may be integral, or may be split to rotate the opposite shaft end **134*a* and its connected gear 136 by utilizing the roller 132 itself to transmit the rotative forces from one frame member 42 across to the other frame member 40**.

Similarly, the cluster drive gear 92 meshes directly with the gear 138. The gear 138 is rotatively connected to the roller 40. The roller gear 138 also rotates it shaft 142, which shaft is directly connected through the upper roller 140 to rotatively drive the roller gear 144 at the opposite frame member 40. The shaft 142 may be integral, or may be split to use the roller 140 itself in well known manner to rotate the opposite shaft end 142*a* and its connected gear 144.

The cluster drive gear 94 meshes directly and indirectly with the gears 150, 52, 54, 56, 58 and 60, all of which are rotatively journalled within the frame member 42. The gear 150 is rotatively connected to a roller, in this case, the upper roller 146. The roller gear 150 rotates its shaft 148, which shaft is directly connected through the upper roller 146 to rotatively drive the roller gear 68 at the opposite frame member 40. The shaft 148 may be integral, or may be split in a manner to utilize the roller 146 to transmit forces across the dryer rack to rotate the opposite shaft end 148*a* (and the connected gear). As above set forth, the gears 54, 56 and 60 are respectively directly connected to rotate the outlet rollers 36, 38 and 24.

Thus it is seen that all of the upper transport rollers 16 and lower transport rollers 18 are rotatively carried within the side frame members 40, 42, but that only the rollers 72, 132, 140 and 146 are directly connected to drive gears, namely the respective roller drive gears 116, 130, 138 and 150. As above set forth, each of the roller drive gears 116, 130, 138 and 150 receives a portion of the power tapped from the main drive system at each gear cluster 108, 110, 112 and 114, to thereby break up the load at the gears driving the rollers at the frame member 40. See FIGS. 2 and 4. All of the upper gears 44 and lower gears 46 mesh to rotatively drive the plurality of upper and lower transport roller 16, 18. However, the complete chain of roller driving gears 44, 46 is powered at four distinct space locations, namely through the roller gears 70, 136, 144 and 68.

As illustrated in FIGS. 2, 4 and 5, the side frame members 40, 42 are suitably joined by conventional spacer rods 152 to provide a sturdy structure. The plurality of upper and lower rollers 16, 18 are rotatively journalled within the side carriers 40, 42 and respectively include transversely extending upper and lower end shafts 154, 156, 154*a*, 156*a*.

Figure 9:
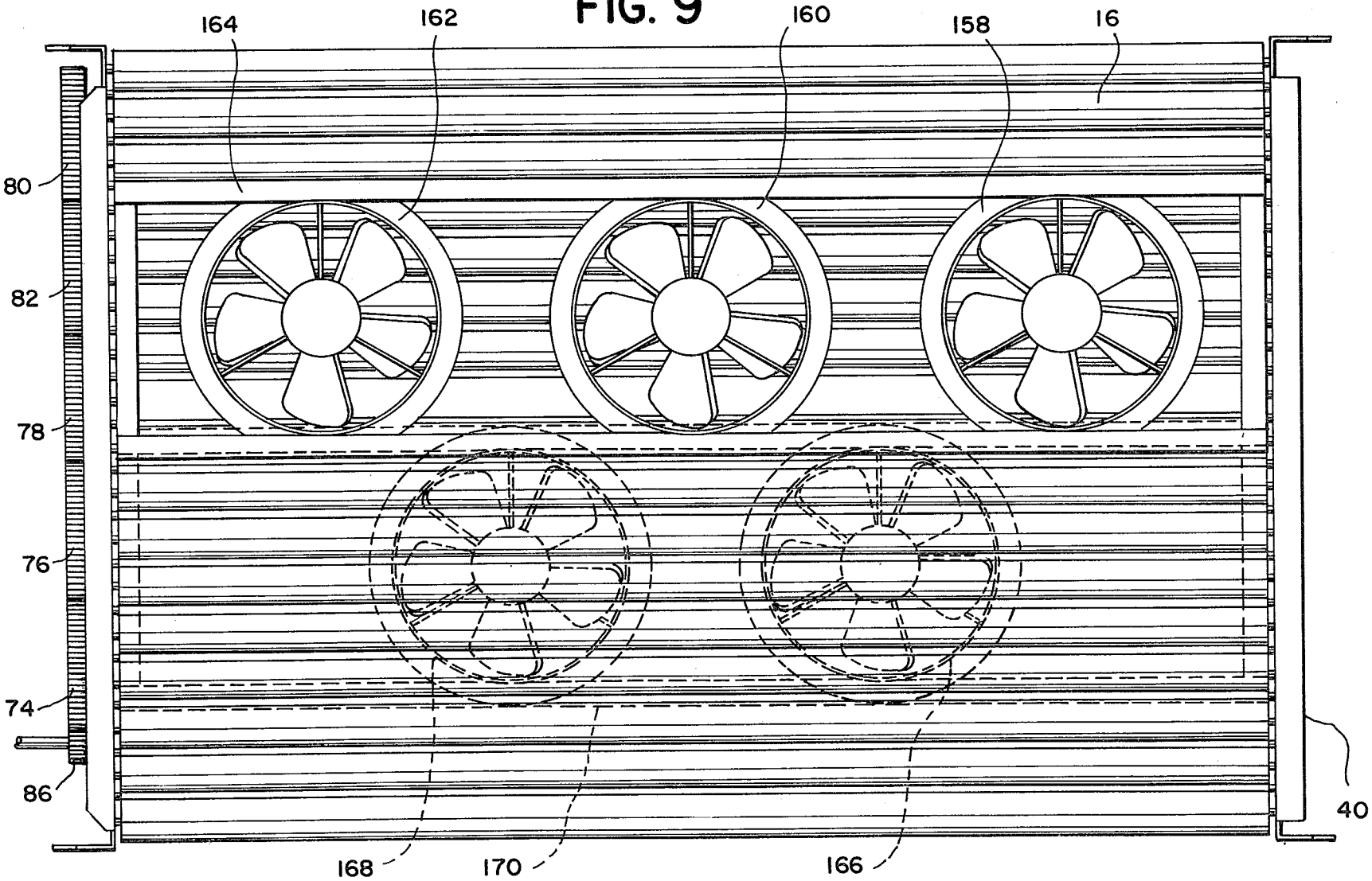
FIG. 9 is a top plan view of the rack of FIG. 1 installed in a film processing machine, viewed from line 9—9 of FIG. 8.

Referring now to FIGS. 8 and 9, the dryer rack 10 is shown in association with a film processing machine 159 at the exit end thereof whereby the processed film 20 can be transported through the dryer rack 10, and delivered from the machine 158 into a conventional hopper 26. A plurality of propeller-type upper fans 158, 160, 162 mounted in an upper tier 164 are positioned above a portion of the dryer rack in a manner to create air flow for film drying purposes generally downwardly toward the transport rollers. A plurality of similar, propeller-type lower fans 166, 168 mounted in a lower tier 170 are positioned below a portion of the dryer rack in a manner to direct air upwardly toward the rollers.

As shown in FIG. 9, in the preferred embodiment the upper tier of fans 164 is not registered over the lower tier of fans 170. Openings 172 are provided in the side frame members 40, 42 to facilitate air circulation from the fans about the films 20 being transported through the dryer rack 10.

The rack construction described above is characterized by all the advantages of the present invention.

Without any necessity for air distribution tubes, supply ducts, and high pressure blowers, jets of drying air are formed by passage of air from the fan tiers 164 and 170 between adjacent transport rollers. This is promoted by the close spacing of the rollers and their rotational movement. Suitable spacing between adjacent rollers positioned on the same side of the film is of the order of about one-eighth inch. This is a small fraction of the spacing between adjacent rollers which prevailed in prior dryer racks where room had to be provided for air distribution tubes.

Many more rollers, of smaller diameters than conventional, are used. Typically about three times as many such rollers are used for a given length of rack embodying the present invention. This materially increases the extent to which moisture is picked up from the surface of the film by contact with the rollers. Moreover, this moisture is more effectively dried, as the rollers revolve, since their surface when facing away from the film is also exposed to flow of drying air which generally impinges upon the whole rack area defined by the rollers and spaces between them.

The much larger-than-conventional number of rollers is precluded from imposing undue strain on the rack driving mechanism by virtue of the driving gear system of power gears, cluster drive gears, and clusters of roller driving gears, which characterizes the present invention. Not only does the efficiency of this system more than offset the added load of the extra rollers (and their individual driving gears), but chatter and vibration in the drive system are simultaneously so markedly reduced that the danger of film blemishes due to uneven rack movement is substantially elmininated.

The staggered roller configuration not only frees the rollers from adherence to close dimensional tolerances, as is necessary to avoid damage to the film when nip-forming configurations are used. It also provides support for the film opposite each gap in which an air jet strikes the film. For example, in FIG. 3, such a jet strikes the film 20 from above in the gap between two adjacent rollers 16. However, in that same gap, the film 20 is supported from below by a roller 18. This is particularly advantageous when the leading end of a film is passing through such a gap, which could otherwise be deflected from its desired path by the air jet and even become entangled in the positions of the rack outside the path defined by the transport rollers.

It will be understood that various modifications of the dryer rack are possible without departing from the scope of the present invention.

For example, the dryer rack need not necessarily be positioned horizontally, but may be positioned vertically, or on an incline, depending on the overall design of the developing machine. The length of the rack, number of fans, fan positions, number of rollers, sizes of rollers, and so forth, can be varied to suit the individual requirements. Likewise the details of the gear drive system can be varied, including the number of power gears, the specific diameter relationship between power gears and cluster drive gears, and so forth, all as explained in our above-mentioned prior patent application and issued patents.

We claim:

1. A dryer rack for transporting and drying webs, such as photographic films, comprising:

a series of transport rollers positioned in a staggered pattern without forming nips to transport the films through the rack along a sinuous path, the rollers positioned on one side of the films being spaced closely enough together so that the rollers alone channel air directed into the spaces between the rollers in a manner which accelerates the air into jets of air impinging on the films transported through the rack, the space between adjacent rollers being free and unobstructed by means for conducting an air flow between the rollers and on sections of films to be dried;

fan means positioned adjacent the rollers for directing air upon at least some of the rollers and upon the films being transported thereby, the air flowing freely from the fan means to the tranport rollers without confinement by ducts or tubes; and means for rotating the rollers including a plurality of power transmitting gears driving each other, a plurality of cluster drive gears coaxially rotated by the power transmitting gears, each cluster drive gear having a pitch diameter smaller than the associated power transmitting gear, and a plurality of clusters of gears for coaxially rotating the transport rollers, each cluster of gears being driven by a cluster drive gear.

2. The rack of claim 1 wherein the spacing between at least some of the adjacent rollers is approximately one-eighth inch.

3. The rack of claim 1 wherein the rollers positioned on opposite sides of the films are spaced substantially equally close together.

4. The rack of claim 1 wherein the fan means comprises at least one low pressure propeller-type fan.

5. The rack of claim 1 wherein the fan means comprises at least two fans positioned on opposite sides of the series of rollers.

6. The rack of claim 1 wherein the fan means comprises a plurality of fans positioned on each side of the series of rollers.

7. The rack of claim 6 wherein all the fan means are low pressure propeller-type fans.

8. The rack of claim 7 wherein the fans are positioned over the rollers to flood with air portions of the roller series extending over substantially the full width of the dryer rack.

9. The rack of claim 1 wherein the cluster drive gears drive, through meshing, gears which coaxially rotate transport rollers.

10. The rack of claim 9 wherein the cluster drive gears operate an auxiliary device rather than coaxially rotate transport rollers.

11. The rack of claim 10 wherein at least some of the gears which coaxially rotate rollers are mounted at the ends of the rollers opposite the ends which are nearest to the cluster drive gears.

12. The rack of claim 11 wherein the power gears are nearest the same ends of the rollers as the cluster drive gears.

13. The rack of claim 1 further comprising nip-forming roller pairs at each end of the staggered roller series for introducing films into and removing films from the rack.

14. The rack of claim 1 wherein the roller series is positioned in two generally straight, parallel rows.

15. The rack of claim 14 wherein the rows are generally horizontal.

16. The rack of claim 1 comprising air transmissive apertures at the side of the rack.

17. The rack of claim 1 wherein the rollers positioned on both sides of the films are spaced closely enough together so that the rollers alone channel air into the spaces between the rollers in a manner which accelerates the air from the fan means into jets of air impinging upon the films.

18. The rack of claim 1 wherein the space beyond the rollers, and between the rollers and the fan means, is also free and unobstructed by means for conducting an air flow between the rollers and on sections of films to be dried.

19. The rack of claim 18 wherein the space beyond the rollers, and between the rollers and the fan means, is free and unobstructed by air distribution tubes or supply ducts.

20. A photographic film developing machine through which films being developed are transported by means of transport roller racks, and a dryer rack for transporting and drying the films, the dryer rack comprising:

a series of transport rollers positioned in a staggered pattern without forming nips to transport the films through the rack along a sinuous path;

fan means positioned on both sides of the series of rollers for directing air upon at least some of the rollers and upon the films being transported thereby freely and without confinement by air ducts or tubes;

the rollers being spaced closely enough together so that the rollers alone channel air into the spaces between the rollers in a manner which accelerates the air from the fan means into air jets impinging on the films transported through the rack in response to the air from the fan means, the space between adjacent rollers being free and unobstructed by means for conducting an air flow between the rollers and on sections of films to be dried; and means for rotating the rollers including a plurality of power transmitting gears driving each other, a plurality of cluster drive gears coaxially rotated by the power transmitting gears, each cluster drive gear having a pitch diameter smaller than the associated power transmitting gear, and a plurality of clusters of gears for coaxially rotating the transport rollers, each cluster of gears being driven by a cluster drive gear.

* * * * *